United States Patent [19]

Parkhurst et al.

[11] Patent Number: 4,526,667

[45] Date of Patent: Jul. 2, 1985

[54] CORROSION PROTECTION ANODE

[76] Inventors: Warren E. Parkhurst, 445 Albrecht La., Durango, Colo. 81301; David Moser, 14276 Holt Ave., Santa Ana, Calif. 92705

[21] Appl. No.: 575,625

[22] Filed: Jan. 31, 1984

[51] Int. Cl.[3] ..... C23F 13/00

[52] U.S. Cl. ..... 204/196; 204/147; 204/220

[58] Field of Search ..... 204/147, 148, 196, 197, 204/219–221, 413

[56] References Cited

U.S. PATENT DOCUMENTS

| | | | |
|---|---|---|---|
| 2,360,244 | 10/1944 | McAnneny | 204/147 |
| 3,215,613 | 11/1965 | Lainson | 204/196 |
| 3,403,090 | 9/1968 | Tajiri et al. | 204/422 |
| 3,616,354 | 10/1971 | Russell | 204/147 |
| 3,616,432 | 10/1971 | Day | 204/220 |
| 3,725,669 | 4/1973 | Tatum | 307/95 |
| 3,728,234 | 4/1973 | Sakai et al. | 204/220 |
| 4,170,532 | 10/1979 | Tatum | 204/196 |
| 4,201,637 | 5/1980 | Peterson et al. | 204/148 |
| 4,204,937 | 5/1980 | Bianchi et al. | 204/220 |
| 4,251,343 | 2/1981 | Peterson et al. | 204/197 |
| 4,318,787 | 3/1982 | Peterson et al. | 204/147 |
| 4,388,168 | 6/1983 | Burkhart | 204/196 |
| 4,400,259 | 8/1983 | Schutt | 204/196 |

*Primary Examiner*—T. Tung

*Attorney, Agent, or Firm*—Griffin, Branigan & Butler

[57] ABSTRACT

A cathodic protection system for protecting a metallic structure (16,74) from corrosion caused by current flowing between the structure and surrounding environment includes a non-ionized metal anode (18) which exists in a liquid state at the particular pressure and temperature at its location in a hole (20) in the earth. The liquid anode (18) is composed of a metal having a specific gravity greater than 10 and a molecular weight greater than, or equal to, 100. In a preferred embodiment, it is mercury. The amount of liquid anode can be adjusted to regulate the density of electrical current emanating from the anode and the hole in which the anode is located includes a measuring system (46) for monitoring the quantity of liquid anode (18) in the earth hole.

9 Claims, 4 Drawing Figures

CORROSION PROTECTION ANODE

BACKGROUND OF THE INVENTION

This invention relates generally to the art of protecting earth-installed metallic structures from corrosion caused by natural, battery-type, reactions between the metallic structures and the earth environment and, more particularly, it relates the anode structures for systems which are used to impress electrical potentials on the metallic structures for preventing such corrosion.

The following terms are defined for purposes of this application:

ANODE—An electrode for an electrical circuit from which electrical current flows into an electrolyte at which oxidation (corrosion) of the surface thereof occurs. Electrodes, including anodes, are never ionized.

CATHODE—An electrode of an electrical circuit into which electrical current flows from an electyolyte at which reduction occurs.

CATHODIC PROTECTION—A technique to reduce corrosion of a metal surface by passing sufficient cathodic current to it to cause its anodic reaction (oxidation and other corrosion) rate to become negligible.

ELECTROLYTE—An ionized chemical substance or mixture containing ions which migrate in an electric field to thereby cause an electrical current to pass therethrough.

It has long been known that earth-installed metallic structures, such as pipelines, oil well structures, and the like, corrode because such structures normally contain both anodic and cathodic areas reacting through air, ground or water electrolytes. In anodic areas, the electric currents flow away from the metallic structures into the surrounding electrolytes and cause oxidation corrosion in such anodic areas. Where electric currents flow from the electrolytes into the metallic structures (cathodic areas), there is negligible corrosion. Thus, in order to prevent such oxidation a corrosion (cathodic) protection system impresses an electrical potential between a ground-embedded electrode and a metallic structure to be protected, such that the electrode is anodic, and the metallic structure is cathodic. By adjusting the amount of current caused by this potential, any corroding currents from anodic areas of the metallic structure are overpowered such that there is a net current flow into the metallic structure at all points. Therefore, the entire surface of the metallic structure will be cathodic and corrosion of the metallic structure is thereby prevented. The ground-embedded electrode (anode), however, corrodes and, in a sense, corrosion is simply being transferred from the metallic structure being protected to the embedded anode.

The efficiency of a ground-embedded anode is a function of such factors as the electrical resistivity of the earth in which it is buried, the depth of burial, the number of anodes, the spacing between anodes, the distance to earth-installed metallic structures to be protected, the efficiency of the anode's connection with the earth, etc. Inasmuch as the resistivity of the soil is usually lower at a greater depth, it is desirable to dispose such anodes as deep as possible. Although some have suggested placing such anodes at depths down to 800 feet, in common practice anodes are normally not embedded much more than 100 feet. One reason for this is that once the anode material has served its intended purpose and has been consumed, the anode-well installation is usually abandoned and a new one is dug. The effective working life of a prior-art anode varies, but rarely exceeds 15 to 20 years. Unfortunately, the metallic systems which these anode installations are meant to protect often have useful lives much longer than this, thereby necessitating the installation of a whole new anode system. Because the first anode system usually must be abandoned and a new one installed, the overall cost of corrosion protection can become prohibitative. It is therefore an object of this invention to provide a cathodic protection anode system which will last as long as the metallic structure which it is intended to protect and for which it is therefore economically practical to dig a deep initial hole for embedding the anode.

There have been a number of suggested anode systems in which the anodes are replaceable and therefore whole new anode systems are not required. Tatum (U.S. Pat. Nos. 4,170,532 and 3,725,669) describe systems wherein anodes located in earth holes are covered with a carbonaceous backfill which provides an electrolyte, or conductor, between the anode and the earth and which is easier to remove for replacing the anode than earth. However, removal of the carbonaceous backfill is still difficult and will only be undertaken when anodes have been essentially completely consumed. In this respect, as anodes are consumed, their electrical properties, such as resistance and conductivity, change due to changes in sizes of the anodes, build-up of reaction (oxidation and other corrosion) material around the outer surfaces of the anodes, and changes in contact between the anodes and the electrolyte in which they are contained. Such changing properties result in ever-decreasing corrosion protection efficiency of most prior-art anode systems. But, in any case, removal of the carbonaceous backfill in the Tatum patents is too difficult to undertake for routine cleaning, or renewal of the anodes. It is an object of this invention to provide anodes for a cathodic protection system the size of which can be continually maintained without the laborious and time-consuming job of removing backfill and the electrical properties of which are not unduly changed due to a build-up of reaction (oxidation and other corrosion) materials, changes in shapes and changes in sizes. In fact, it is an object of this invention to provide an anode for a cathodic protection system whose size and condition can be continually maintained to control the density of electrical current flow in a cathodic protection system while maintaining near perfect electrical contact with the surrounding earth. It is also an object of this invention to provide such an anode which can be installed without the necessity of stocking a special backfill material and which can be continually serviced and renewed without removing it from its operating position.

Schutt (U.S. Pat. No. 4,400,259) describes a buried anode assembly in which the anode is formed of a continuous, rope-like element. The size of this anode is not variable and build up of corrosion products, and changes in size from such corrosion, will still significantly affect contact between this anode and the surrounding earth. Further, this anode must be periodically pulled out of its well and replaced. It is an object of this invention to provide an anode which does not have to be periodically removed from a well, whose performance is not significantly affected by corrosion, which does not have to be replaced and whose size is selectively variable without adversely affecting its contact with the earth.

Peterson et al. (U.S. Pat. No. 4,318,787 and 4,201,637) describe sacrificial anodes for use in the ocean in which compositions can be introduced into anode housings through conduits. In the system described by Peterson et al. (U.S. Pat. No. 4,318,787), an electrode material comprising a major amount of particulate anode material and a minor amount of a fluid carrier material is pumped, or allowed to flow, into an anode extrusion die where it remains in a fixed shape. This anode is not for use in the ground inasmuch as the rigid, paste-like material, would not come into sufficiently intimate contact with the earth and its electrolytes to conduct the required current. Also, in this system one cannot adjust the shape of the electrode in situ inasmuch as the composition is not sufficiently fluid therefor. Still further, because of the looseness of the particulate anode material used for this electrode, an undue amount of anode material is required in order to protect a metallic structure. Yet another difficulty with this anode is that one cannot easily measure the quantity and size of the anode from the surface of the water in which the anode is mounted. This anode also suffers because its electrical characteristics are affected by corrosion of the anode itself; corrosion materials cannot be easily cleaned therefrom in order to renew it. It is an object of this invention, to provide an anode for use in the earth whose size can be selectively maintained and which has a sufficient molecular weight and density that an undue amount thereof is not needed to protect a metallic structure. In addition, it is an object of this invention to provide such an anode whose size can be easily ascertained from the surface of the earth and whose electrical properties are not unduly affected by reaction (oxidation and other corrosion).

It is another object of this invention to provide an anode which can be mounted in an existing, producing, gas or oil well without affecting the production thereof but yet has all of the above-named advantages of this anode.

SUMMARY

An anode for a cathodic protection system comprises a non-ionized metal which exists in a liquid state at the particular pressure and temperature at its location in a hole in the earth so that gravity continuously causes the liquid anode to conform to the shape of the hole. The specific gravity of the non-ionized metal preferably is greater than 10 and has a molecular weight greater than or equal to 100. Mercury is a material which can be used as the electrode. Apparatus are provided for introducing such a liquid metal into a hole in which it is to be installed. Electrical contacts mounted in the hole provide an indication at the surface of the earth as to the height of the mercury and hence the surface area dispersing electrical current.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
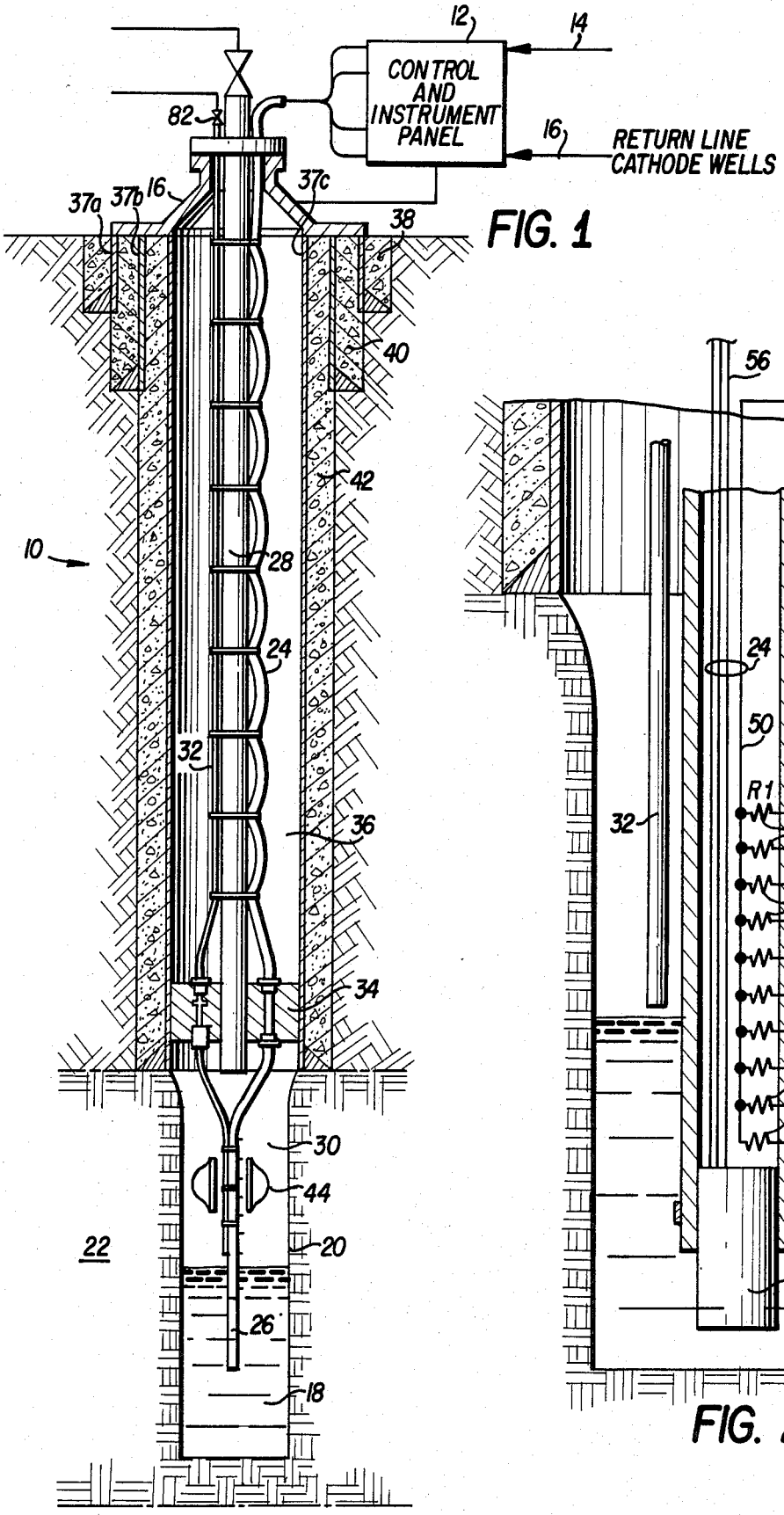
FIG. 1 is a cross-sectional, partially schematic, view of a cathodic protection system of this invention mounted in an earth hole, sometimes referred to herein as an anode well.
Figure 2:
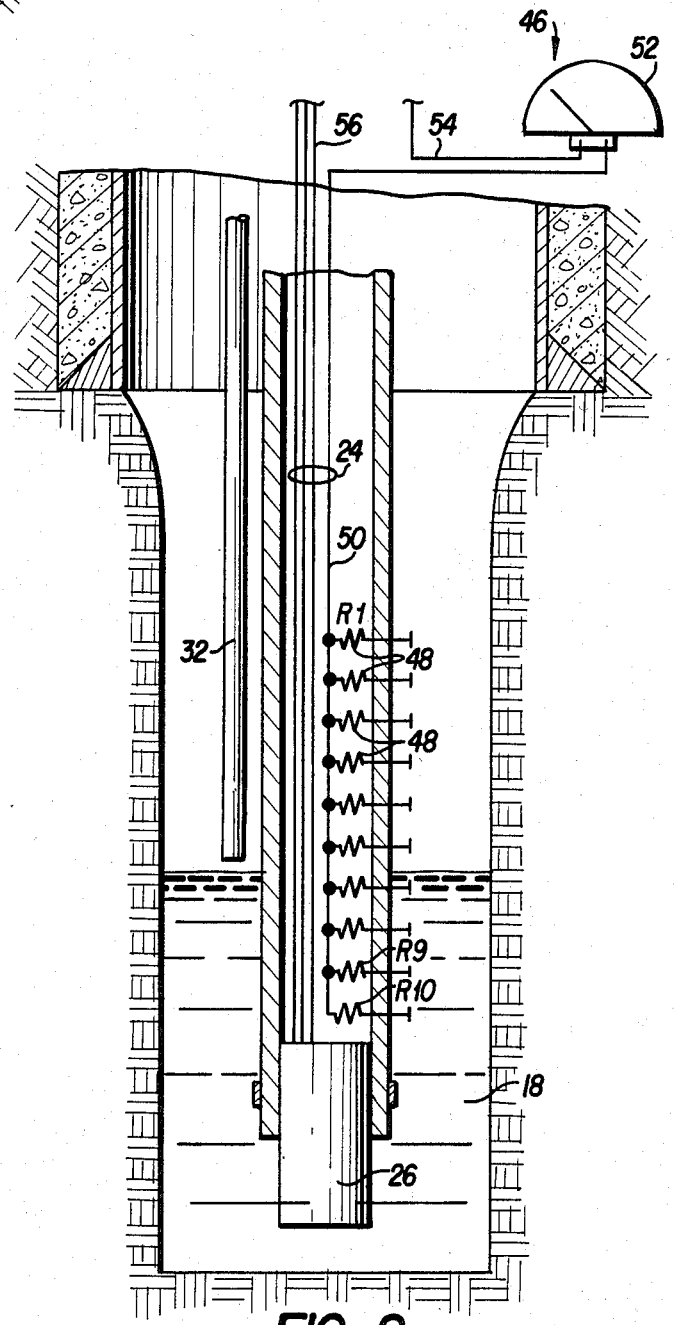
FIG. 2 is an enlarged view of the lower portion of the cathodic protection system of FIG. 1.

Referring to FIGS. 1 and 2, a cathodic protection system comprises an anode well 10, a control and instrument panel 12, and a power supply 14. Basically, the power supply 14 is AC voltage and current obtained from commercial power companies, or other source, which the control and instrument panel 12 rectifies and applies as DC voltage between well-head frames (and tubulars) 16 to be protected, and an anode 18. In a preferred embodiment, the anode 18 comprises a column of mercury which is simply contained within an unlined hole 20 which is dug in the earth to a corrosive water zone 22. The mercury anode 18 is connected to the control and instrument panel 12 via a conductor in a conductor bundle 24 and an electrode tip 26 which is immersed in the mercury anode 18. The electrode tip 26 can be platinum plated or can be made of some other suitable materials including carbon, tungsten and combinations thereof. Non-ionized liquid metals other than mercury could be used as the anode 18, however, they should generally have the following properties:

1. a specific gravity greater than 10.0;
2. an electrical resistivity less than 0.001 ohms/cm;
3. an interfacial tension with water which is greater than, or equal to, 300 dyne/cm;
4. chemical inactivity with well bore fluids and solids:
   a. reaction constants being greater than 100/1 favoring stability; and
   b. solubility constants being greater than 100/1 favoring stability;
5. vapor pressure at the bottom of the hole must be less than or equal to 10 psi;
6. molecular weight must be greater than or equal to 100 for low mass consumption of the anode; and
7. the boiling point must be greater than 120° C. at atmospheric pressure.

A purge gas tube 28 extends from the earth's surface outside the well into the gaseous zone 30. A reaction-gas out-tube 32 also extends from outside the well into the gaseous zone 30 to a point just above the surface of the anode 18. A packer 34 separates chemically-treated water 36 for preventing corrosion within the annulus of the well tubulars from the gaseous zone 30. The gaseous zone 30 is normally maintained pressurized to balance the natural pressure of the fluids contained in surrounding rock formations and to stop their tendency to flow into the gaseous zone 30 and the liquid anode 18, thereby shorting out electrical circuits. By controlling the pressure of this zone one can "clean" the anode 18 as will be explained below.

The well hole is normally cased at the top with steel casings 37*a* and *b* held in position by layers of cement 38 and 40 and over the balance of its depth by a single casing 37*c* held in position by a single layer of cement 42. However, that portion 20 of the anode well 10 in which the aode 18 is mounted is not lined. The well head 16 covers the top of the well. The conductor bundle 24 and the reaction-gas out-tube 32 are attached together in the gaseous zone 30 and are held away from ground walls 20 by centralizers 44, which are merely spring-like devices surrounding these two tubes for holding them in the center of the hole 20.

The anode 18, the electrode conductor tip 26, and a level-meter system 46, are shown in more detail in FIG. 2. The level-meter system 46 comprises various parallel resistors of graduated values $R_1$–$R_{10}$ 48 located along the conductor 50. The conductor 50 is coupled directly to a level meter 52 located on the control and instrument panel 12 of FIG. 1. The level meter 52 is also connected via a conductor 54 with a negative or grounded terminal. Only the outer tips of the resistors 48 are arranged to contact the mercury if the mercury is as high as the respective resistors. It can readily be seen by reference to FIG. 2, that the height of the mercury anode 18 will affect the amount of current flowing between the conductors 54 and 50 by controlling which of the resistors $R_1$–$R_{10}$ 48 are in the circuit because of contact between the resistors 48 and the mercury 18. Thus, from the sizes of the resistors the level meter 52 can be calibrated to provide an indication of the level of the mercury anode 18.

Figure 3:
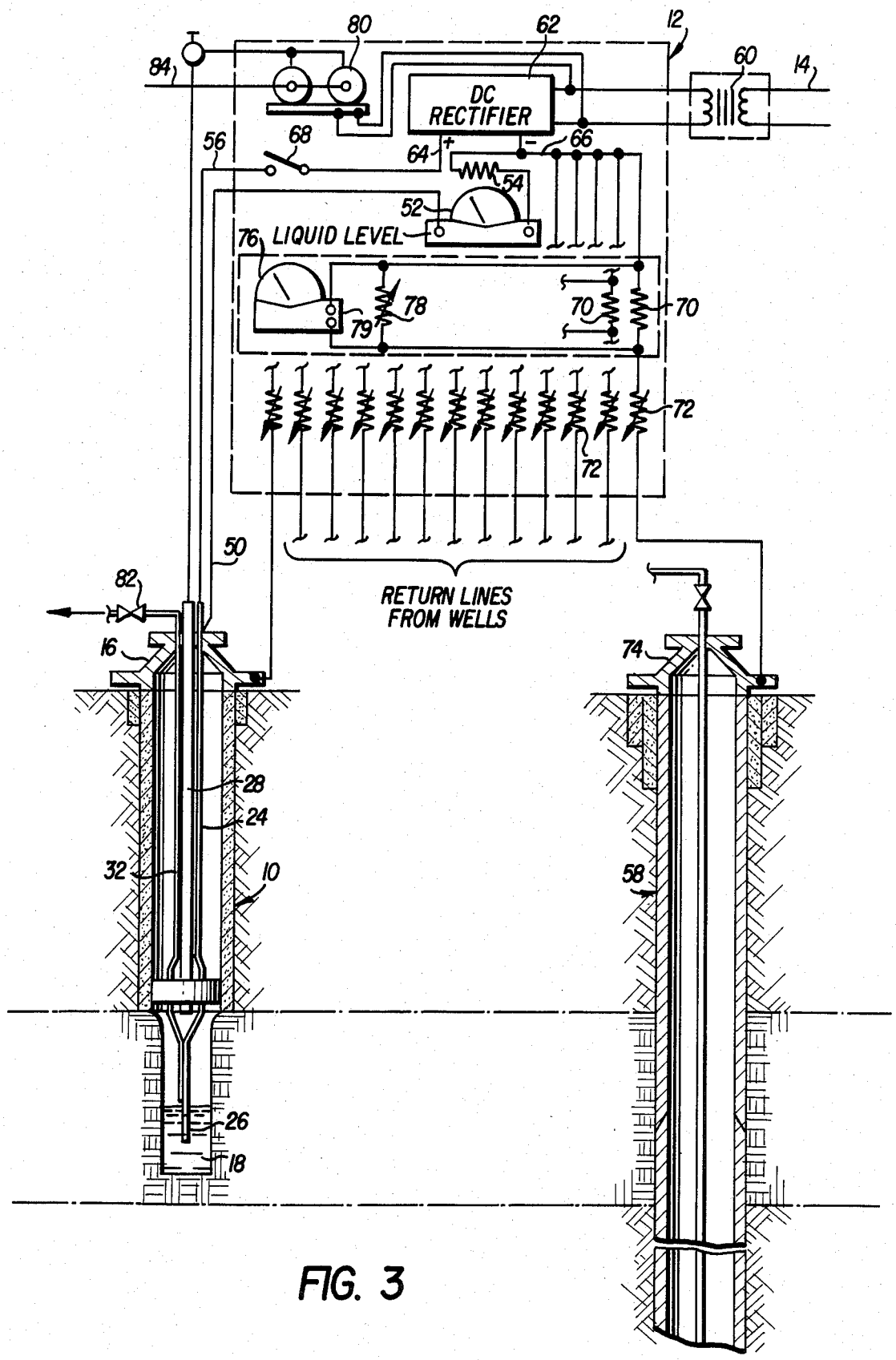
FIG. 3 is a side cross-sectional view, partially schematic, of a cathodic protection system including an anode well, an oil well being protected, and power and instrument controls therefor; and, FIG. 4 is a side sectional view, partially schematic, of the anode of a cathodic protection system of this invention mounted in an oil well which is equipped to produce by "gas-lift".

Describing FIG. 3, this drawing depicts an anode well 10 of the type described in relation to FIGS. 1 and 2, an oil well 58 (some of whose tubulars and other metallic parts are being protected by a cathodic protection system of this invention), a control and instrument panel 12 (in much more detail than is depicted in FIG. 1), and a power supply 14. The power supply 14 includes a step-down power transformer 60 to transmit lower-voltage electrical energy from a power company or other source to the control and instrument panel 12. The control and instrument panel 12 includes a full wave rectifier 62 which converts this AC electrical energy to DC, placing a positive charge on positive-charge line 64 and a negative charge on negative-charge line 66. The positive-charge line 64 is connected, as previously described, via the conductor 56 and the electrode conductor tip 26 to the non-ionized liquid-metal anode 18, with a main switch 68 being added to activate and deactivate the system. The negative-charge line 66 is connected via parallel-connected current-measuring resistors 70 and control resistors 72 to the frames of respective metallic, earth-buried, structures, such as the well head 74 of the oil well 58 and the well head 16 of the anode well 10; thus, a plurality of controllable electrical protection loops, each for protecting specific structures, are formed. A galvanometer 76 is connected across each current-measuring resistor 70 in parallel with a calibrating variable resistor 78 to measure the corroding-resistance current flowing to tubulars and frames being protected by that particular protection loop. The control resistors 72 are variable to allow control of the current flowing in each electrical protection loop.

The liquid-level meter 52, as was described above, receives current flowing from the electrode conductor tip 26 back to the liquid-level meter 52 via the liquid anode 18 which is touching various outer tips of resistors 48 (FIG. 2) and the conductor 50.

Also powered from the step-down AC voltage received from the step-down power transformer 60 or other source, is a purge-gas compressor 80, which, if required, furnishes purge gas to the gaseous zone 30 above the liquid-metallic anode 18 via the purge-gas tube 28, with the purge gas being vented from the well by the reaction-gas out-tube 32 and a pressure-relief vent valve 82. Purge gas is supplied to the purge-gas compressor 80 at a purge-gas inlet tube 84. Of course, if the purge gas supplied to the instrument panel 12 is at a high enough pressure already, the purge gas compressor 80 is not required. The purge gas is normally a natural gas, such as methane or ethane, which is usually readily available at an oil or gas well site; however, any inert gas (inert in the underground conditions in which it is used) will suffice.

In operation, a cathodic protection system of the type described herein is designed by calculating the total normalization current required to protect steel material; that is, the amount of current which will be measured by the ammeters 79. From this total current value one calculates the height of the anode necessary in order to achieve a desirable current density at the anode. The anode height, of course, determines its surface area. Considerations in determining a desirable current density include: (1) larger current densities consume the anode faster; (2) the resistivity of the earth can create undesirably high voltages in the system; (3) a larger anode produces better current distribution to the structures being protected; etc. In a currently preferred embodiment the current density is between 1–5 amps per square foot, however, it should be emphasized that considerations at a site could dictate a current density outside of this range. Similarly, in a currently preferred embodiment, the anode height is from 20 to 100 feet high, however, on site considerations could also cause this to vary. Using subsurface electrical logs which are normally produced for all wells in the oil and gas industry, one determines the most advantageous depth at which to install the metallic-liquid anode 18. There is no theoretical limit at which these advantageous depths are located, although mechanical and temperature considerations, within the current state-of-the-art, would probably limit installation to within around 20,000 feet. However, it is anticipated that anode wells of this invention will usually be in the 2,000 to 5,000 feet range.

An anode well 10, as is depicted in FIGS. 1, 2, and 3, is constructed by drilling a 16 inch hole to approximately 40 feet, setting a $13\frac{3}{8}$ inch causing 37*a* with an annular cement lining 38, drilling a $12\frac{1}{2}$ inch hole approximately 220 feet deep and then setting a $10\frac{3}{4}$ inch casing 37*b* with a second annular layer of cement lining 40. Next a $8\frac{3}{4}$ inch hole is drilled to a depth just above the zone 22 into which the anode 18 is to be embedded according to logs, and a 7 inch casing 37*c* is cemented into place in this hole. Finally, a $6\frac{1}{2}$ inch hole, hole 20 in FIG. 1, is drilled into the zone 22 into which the anode 18 is to be implanted, and this hole is not lined. While carrying out this last step, core samples are retrieved and analyzed for use as will be further discussed below. The various elements, such as the conductor bundle 24, the purge-gas tube 28, and the reaction-gas outlet tube 32, are threaded through the packer 34, and at below-packer structure, including the centralizers 44 are prepared above ground. The packer, and these attached elements, are then installed in the well with the electrical conductor tip 26 being located at the approximate anticipated depth center of the liquid-metal anode 18. The chemically-treated water 36 is pored into the hole above the packer 34.

To start up the system, a metallic-liquid electrode is poured down the $2\frac{7}{8}$ inch purge-gas tube 28 and the reaction-gas, pressure-relief vent valve 82 is held open. The purge-gas compressor 80 is operated to pressure up the purge-gas system, thereby injecting purge gas into the gaseous zone 30 above the metallic-liquid anode 18 and the pressure of this purge gas causes any liquid in the gaseous zone 30 to be expelled through the reaction-gas outlet tube 32. The compressor continues to circulate gas until water ceases to be ejected from the reaction-gas outlet tube and thereafter the compressor 80 and the pressure-relief vent valve 82 are controlled to hold the pressure in the gaseous zone 30 to around 1200 psi, for example. At this point, using the liquid-level meter 52, one monitors the level of the metallic liquid electrode 18 and adds metallic liquid as is required to stabilize the level at the desired level, as will be further described below. The control resistors 72, each of which is attached to a separate metallic well structure to be protected, are then set to their highest values and the main switch 68 is closed to apply power to the liquid anode system. The purge-gas compressor 80 and the vent valve 82 are appropriately operated as required during this period to purge reaction waste from the metallic-liquid anode 18 out of the purge-gas vent valve 82 and to maintain the required pressure in the gaseous zone 30. The current flowing through each of the resistors 72 (or other current control devices) is monitored via ammeters 76, and these resistors 72 are adjusted so that all corrosion-protected structures are drawing approximately the same amount of amperage per unit area of steel surface to be protected. For an initial period, the system should be monitored and the resistors reset until the system stabilizes. Thereafter, a regular maintenance schedule should be set up to provide routine monitoring and maintenance.

With regard to the height of the metallic-liquid anode 18, the amount of mercury required to achieve a desired height is determined from the rock-formation samples taken at the position of the anode. In this respect, the height of the liquid-metallic anode when installed determines the pressure at the bottom of the liquid-metallic anode. In turn, the pore size distribution of the rock formation in relation to the surface (interfacial) tension of the anode material determines the amount of flow of the liquid-metallic anode material into the pore spaces in the rock formations. More particularly, the desired height of a mercury column to provide a predetermined surface area, and thereby a current density flowing from the anode at a predetermined maximum current requirement, is determined. Then, using the rock-formation pore size distribution, one calculates the volume of mercury which will be displaced into the particular rock formation to supply the required height of mercury column and hence the mercury which will be required to attain the necessary column height in the well bore. In this respect the mercury will flow into larger pores until it encounters smaller pores into which it will not flow.

Thus, the anode volume is adjusted to attain the desired height by adding liquid metal material via the purge-gas tube 28 in order to control the current density flowing from the anode. It will be understood by those skilled in the art, that since the liquid anode is forced by pressure into the interstices in the rock formations, there is an excellent electrical connection between the anode 18 and the electrolytes contained in the rock formations.

In order to "clean" or "renew" the anode 18 when its electrical properties have been adversely changed by buildup of reaction materials around the outer surface, the pressure in the gaseous zone 30 is reduced (from 1200 to 800 or 900 psi, for example), so that water from the surrounding earth is allowed to flow around the anode 18. This water, carrying with it the reaction materials, rises to the surface of the anode 18 and is expelled by purge gas pressure through the out-tube 32. Thereafter, the pressure in the gaseous zone 30 is again increased to hold earth liquids out of the gaseous zone 30 so that it does not flow around the anode 18.

Figure 4:
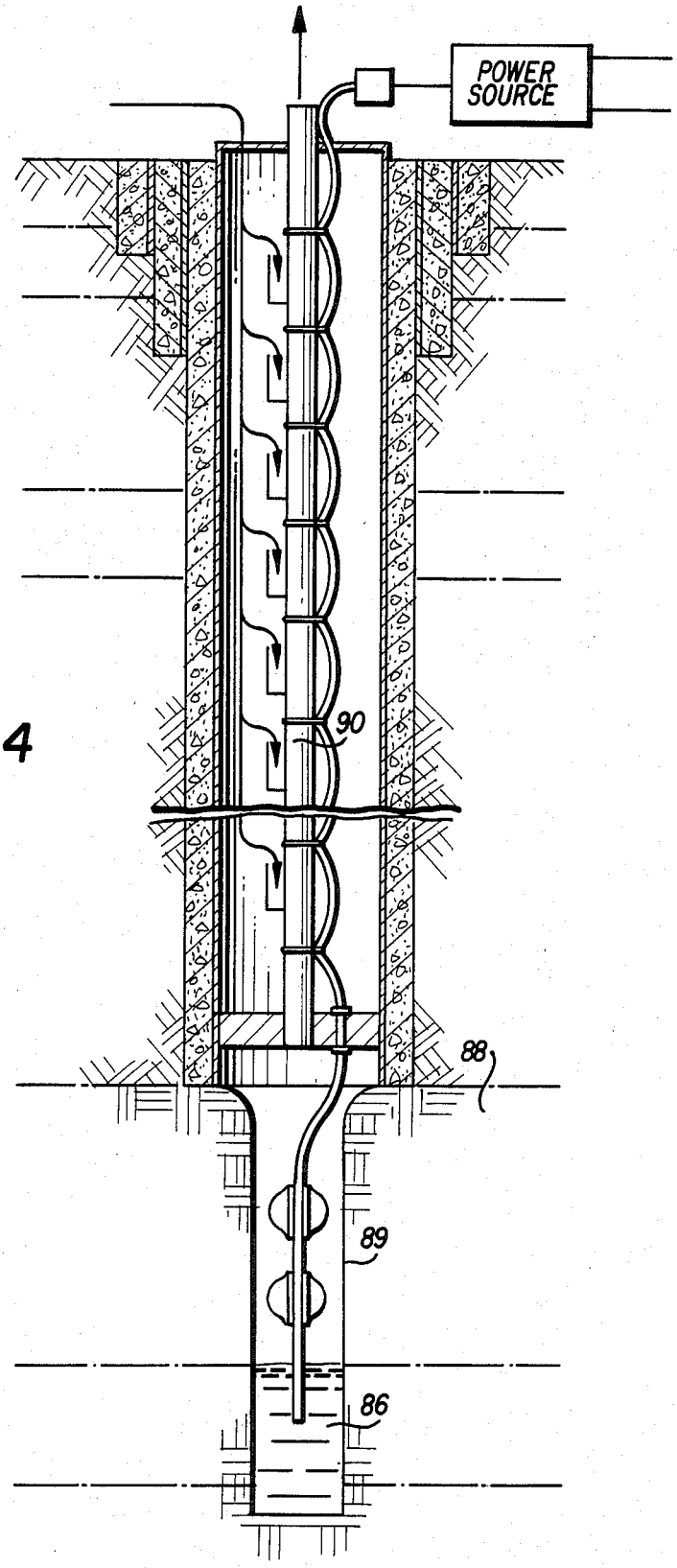

Describing briefly the installment of a liquid-metal anode in a producing oil well, with reference to FIG. 4, a hole is prepared below an oil-productive zone 88 and a liquid anode 86 poured into it via a hydrocarbon production tube 90. In the particular well shown in FIG. 4, oil from an oil-productive zone 88 travels to the surface by means of gas expansion energy via an open hole 89 up through the hydrocarbon production tube 90. The liquid anode 86 is actually positioned in an extension of the open hole 89. This system differs from that of FIG. 1 in that there is no gaseous zone 30 over the metallic-liquid anode, but rather oil and gas are thereover. In this case, the anode reaction materials are purged from the anode by the oil and gas which exit through the open hole 89 and the hydrocarbon production tube 90. Thus, there are no purge-gas tubes, as such, and reaction-gas outlet tubes in this system as in the FIGS. 1–3 system. Although it is not shown in FIG. 4, this system includes the same resistance apparatus for determining the height of the liquid anode 86 in the well bore as the FIGS. 1–3 embodiment. This embodiment is particularly well suited to be used to protect the tubulars of a single ocean well, in which case each ocean well will have its own corrosion-protection system. A separate anode well in the ocean is not particularly satisfactory because of the impossibility of controlling uniformity of current flow with all wells being shorted together at the surface by the salt water and mechanical support systems.

It will be understood by those skilled in the art that the liquid-metal anode of this system is completely renewable from the earth's surface, as the anode is consumed, with very little effort. Further, the system provides a means for easily measuring the rate and amount of consumption of the anode. Yet another advantage of this system is that not only can it be installed in a new well which is specifically made for a liquid anode, but it can be installed in an existing, operating, oil or gas well as is depicted in FIG. 4.

One feature of this invention which makes it particularly desirable is that the anode itself can be used to vary current density by varying the liquid column height of the anode and thereby controlling the amount of interfacial contact between the anode and the earth electrolyte.

One significant advantage of this invention is that either a purge gas or produced oil and gas exhausts reaction products from the vicinity of the anode to the earth's surface, thus, these reaction products do not build up to increase resistance between the anode and the soil electrolyte.

Still further, the high relative density and non-miscibility of a liquid-metallic anode keeps it from being "blown out" of an operating well accidentally. However, it can be easily removed if ever desired by a mechanical "bailer" operated on a wire-line reel, a common tool in the oil industry.

Because of the permanence of this system, that is, the anode is continually, and easily, renewable in situ, it can be economically mounted at much greater depths than conventional, fixed-size electrodes, thereby enabling one to take advantage of better operating characteristics which are often found at deeper depths.

With this system installed in an individual well, that well's tubulars can be protected individually by impressed voltage control, making the system particularly useful in offshore installations where all wells are commonly grounded electrically at the surface and electrical return cable control is impossible.

While the invention has been particularly shown and described with reference to preferred embodiments, it will be understood by those skilled in the art that various changes in form and detail may be made therein without departing from the spirit and scope of the invention. For example, liquid metals other than mercury can be used as the liquid-metallic anode. Further, other equipment arrangements than those actually depicted in the drawings herein can be used for carrying out this invention.

The embodiment of the invention in which an exclusive property or privilege is claimed is defined as follows:

1. A cathodic protection system for protecting a metallic structure from corrosion caused by electrical currents flowing between said metallic structure and surrounding atmosphere, said cathodic protection system comprising:

an electrical anode located in and contained by a hole in the earth so as to be in intimate physical and electrical contact with the surrounding earth defining said hole whereby electrical current can flow freely between the anode and the electrolytes in the earth;

a voltage-impression means for impressing a DC voltage between said metallic structure to be protected and said anode whereby said anode is made to be substantially electrically positive relative to said metallic structure thereby causing current to flow from said anode to said metallic structure through said earth to prevent corrosion on said metallic structure;

said anode comprising a non-ionized metal which exists in a liquid state at the particular pressure and temperature at its location in said hole whereby gravity causes said liquid anode to continually conform to the shape of said earth hole containing it and to be in physical and electrical contact with said earth defining said hole.

2. A cathodic protection system as in claim 1 wherein the specific gravity of said non-ionized metal has a specific gravity greater than 10.

3. A cathodic protection system as in claim 1 wherein said non-ionized metal has a molecular weight greater than, or equal to, 100.

4. A cathodic protection system as in claim 1 wherein said non-ionized metal is mercury.

5. A cathodic protection system as in claim 1 wherein a means for changing the amount of electrode in said hole is included, said means comprising a means for transferring said non-ionized metal from the surface of said earth to the bottom of said hole in which said anode is located.

6. A cathodic protection system as in claim 5 wherein is further included a means for measuring the quantity of said non-ionized metal in said hole and providing an indication thereof at the surface of said earth.

7. A cathodic protection system as in claim 1 wherein is further included a means for measuring the quantity of said non-ionized metal in said hole and providing an indication thereof at the surface of said earth.

8. A cathodic protection system as in claim 1 wherein said non-ionized metal has an interfacial tension with water which is greater than, or equal to, 300 dyne/cm.

9. A cathodic protection system as in claim 8 wherein is further included a means for measuring the quantity of said liquid non-ionized metal in said hole and providing an indication thereof at the surface of said earth.

* * * * *